United States Patent [19]

Simms et al.

[11] Patent Number: 4,989,839

[45] Date of Patent: Feb. 5, 1991

[54] AUTOMATIC TUYERE PUNCHER

[75] Inventors: Dale Simms, Kirkland Lake; Walter A. Dutton, Mississauga; Norman Seymour, Kirkland Lake; Albert Pelletier, Candiac, all of Canada

[73] Assignee: Noranda Inc., Toronto, Canada

[21] Appl. No.: 407,656

[22] Filed: Sep. 15, 1989

[30] Foreign Application Priority Data

Sep. 15, 1988 [CA] Canada ..... 577548

[51] Int. Cl.[5] ..... C21B 7/16

[52] U.S. Cl. ..... 266/80; 266/47; 266/269

[58] Field of Search ..... 266/47, 80, 269, 271

[56] References Cited

U.S. PATENT DOCUMENTS 2,922,175 1/1960 DeVillers et al. ..... 266/269
4,303,229 12/1981 Iyama et al. ..... 266/271
4,353,530 10/1982 Iyama et al. ..... 266/269

FOREIGN PATENT DOCUMENTS 7106684 2/1971 Japan ..... 266/269

*Primary Examiner*—S. Kastler

*Attorney, Agent, or Firm*—Fleit, Jacobson, Cohn, Price, Holman & Stern

[57] ABSTRACT

A system for automatically or semi-automatically controlling the operation of a tuyere puncher comprises a distance measuring device which measures the distance of the puncher from a reference position, and a programmable device having a memory which may be used to store the position of each tuyere relative to such reference position, the capability of communicating with the distance measuring device to obtain the current puncher position, input capability to read signals from external devices, output capability to control indicating devices and the movement and punching operations of the puncher, and the calculating facility to determine the motion of the puncher to punch all possible punchable tuyeres.

12 Claims, 7 Drawing Sheets

AUTOMATIC TUYERE PUNCHER

This invention relates to a system for automatically or semi-automatically controlling the operation of a tuyere puncher.

During smelting of certain metals by pyrometallurgy, it is common practice to remove impurities contained therein by blowing air or oxygen enriched air into the melt. The air is forced into the molten metal through tuyeres which are submerged under the surface of the metal in the smelting vessel. During this operation the cool air freezes molten material and forms encrustations at the tip of the tuyeres inside the vessel. In order to maintain efficient operation of the smelting vessel, it becomes necessary to remove these encrustations to prevent blocking of the tuyeres.

It has been the practice for a number of years to remove the formed encrustations manually by inserting a bar into the tuyeres of the smelting vessel. This operation was however very inefficient and various types of mechanical punchers were developed to increase productivity. One such machine which has become widely known as the Gaspe puncher is disclosed in Canadian patent No. 727,540 granted Feb. 8, 1966. Although this machine proved to be a significant improvement in efficiency, an operator was required on the machine to line up the punch bars of the machine with the tuyeres and activate the puncher stroke. Such operator was exposed to the poor working conditions prevailing around the smelting vessel such as noise, heat, dust, etc, and there was therefore a need to automate the tuyere puncher so as to remove the operator from the immediate vicinity of the smelting vessel.

Canadian Patent No. 1,147,553 discloses an apparatus for automatically punching the tuyeres of a smelting vessel. However, the patented apparatus requires a number of light emitting elements and detectors mounted on the tuyere puncher aligning with stationary light intersecting plates, one for each tuyere. This delicate equipment is liable to be damaged during normal operation of the puncher or the smelting vessel.

It is therefore the object of the present invention to provide a simpler and more versatile system which may be easily adapted to conventional mechanical punchers to render these machines fully automatic and thus greatly improve the working conditions of the operator.

The system in accordance with the present invention comprises a distance measuring device to measure the distance of the tuyere puncher from a reference position, and a programmable device having a memory for storing the position of each tuyere relative to such reference position, the capability of communicating with the distance measuring device to obtain the current puncher position, input capability to read signals from external devices, output capability to control indicating devices and the movement and punching operations of the puncher, and to punch all possible tuyeres.

The distance measuring device preferably includes the above memory for storing the position of each tuyere relative to the reference position and means to control the motion of the puncher toward each tuyere position.

The programmable device is preferably a programmable logic controller (PLC) having a plurality of input/output modules for providing the above input/output capabilities and a basic language module for providing the above calculating facility to determine the motion of the puncher and the capability to communicate with the distance measuring device.

The system is further provided with a main control panel acting as an operator interface and having mounted therein a plurality of tuyere status switches, one for each tuyere, which allow an operator to block out any tuyere from being punched, and a plurality of bar status switches, one for each punch bar used by the tuyere puncher, such tuyere and bar status switches being connected to the I/O modules for providing input signals which allow the basic module to calculate the next valid station for punching.

An operational mode selector switch is provided on the main panel and connected to the I/O modules to allow the operator to control the mode of operation of the tuyere puncher for automatic, semi-automatic or manual operation.

A punch mode switch is also mounted on the main panel and connected to the I/O modules to allow the option of starting and stopping punching based on air flow or pressure through the tuyeres, starting at a fixed time, or both.

A timer/counter access module (TCAM) is also mounted on the main panel and connected directly to the memory to allow the operator to read and change data stored in the memory.

A CRT and keyboard could be used instead of the above main panel as an operator interface with the system.

A pendant or remote control panel is located on the tuyere puncher or in the vicinity of the puncher and comprises joysticks for control of manual or semi-automatic operation of the puncher and an operational mode selector switch.

The invention will now be disclosed, by way of example, with reference to the accompanying drawings in which.

Figure 1:
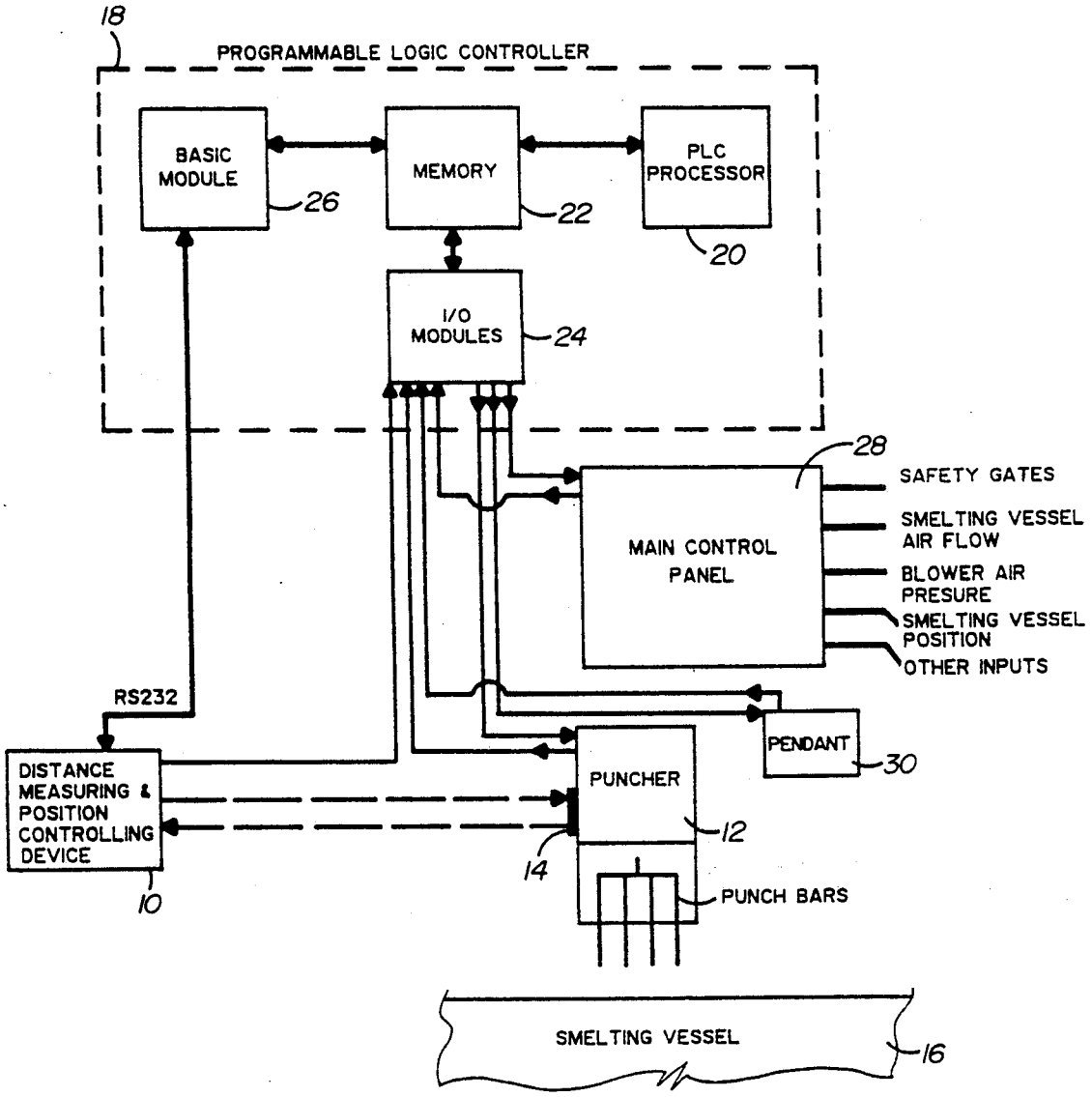
FIG. 1 is a block diagram of the system for controlling the operation of the tuyere puncher.

Referring to FIG. 1, there is shown a distance measuring and position controlling device 10 which is mounted at a certain distance from a tuyere puncher 12 but able to sight on a reflector 14 mounted on the puncher to accurately measure the distance of the puncher from a home position at either end of a smelting vessel 16. One such device is the so-called BCS (Brake Control System) marketed by TeleControls which uses infrared light from a light emitting diode to measure distance with an accuracy of about 0.25 cm. It also contains a microcomputer and memory which allows it to store "station" position, to communicate with a microcomputer or other device and to control the motion of a device. It is to be understood that any other equivalent distance measuring and position controlling device with integrated or separate microcomputer and memory could also be used.

The above distance measuring and position controlling device communicates with a programmable logic controller (PLC) 18 which is a microcomputer provided with a PLC processor 20, a memory 22, a number of I/O modules 24 and a BASIC module 26. The programmable logic controller controls the overall operation of the tuyere puncher. Generally speaking, it receives control signals from the distance measuring and position controlling device 10, checks the status of all input signals received by the I/O modules and sends output signals via the I/O modules to alarm lights on a main control panel 28 and to solenoids (not shown) controlling motion of the tuyere puncher and the punching mechanism itself. It is the heart of the system as it calculates when and where to punch and sends tuyere location signals to the distance measuring and position controlling device 10 which then controls the movement of the puncher via the I/O modules 24. A suitable programmable logic controller is the TI 530C marketed by Texas Instruments. It is to be understood that other equivalent controllers could also be used.

Figure 2:
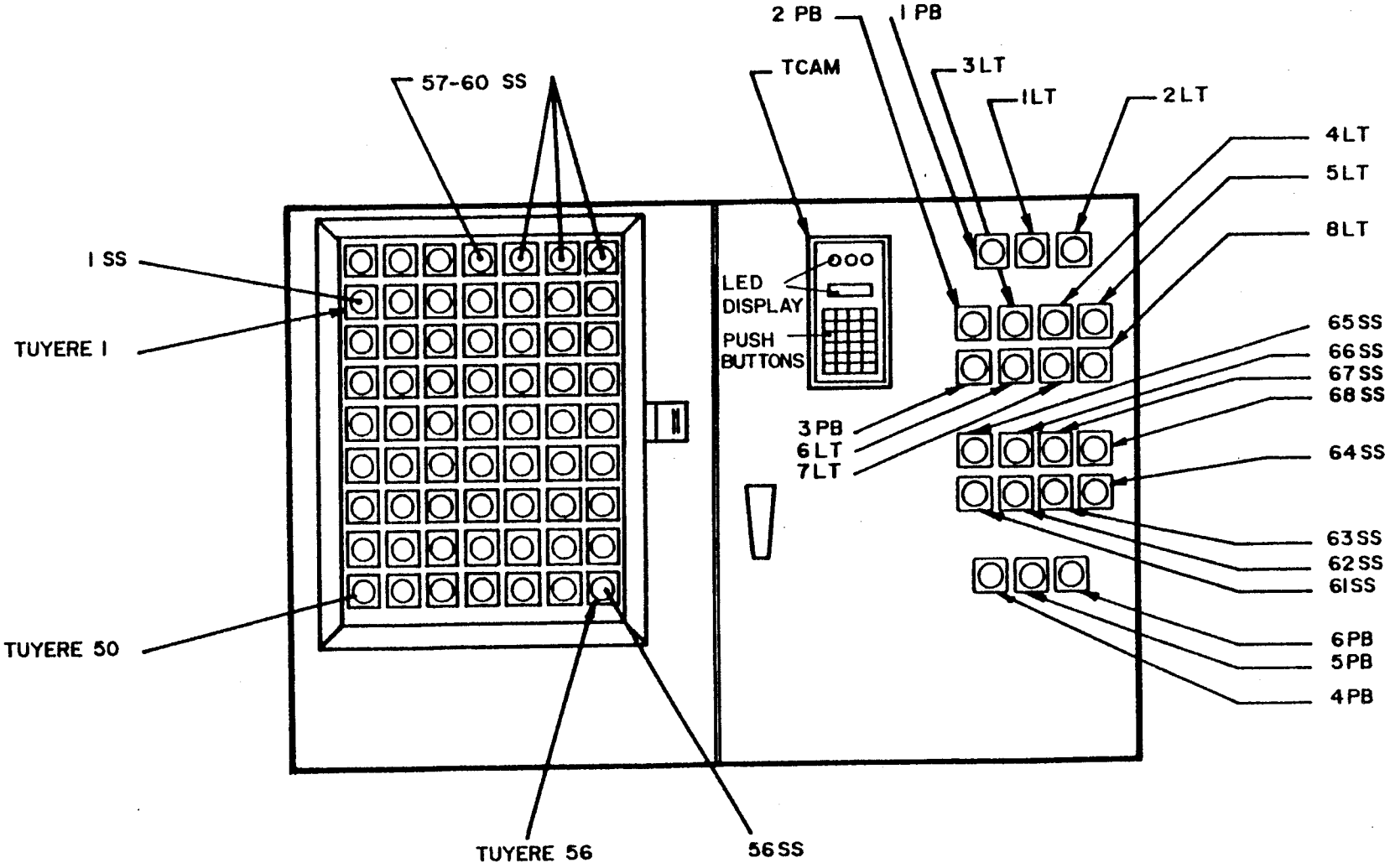
FIG. 2 illustrates the main control panel of the system.

The main control panel has mounted on its surface status switches and lights for operator use as illustrated in FIG. 2. These switches and lights are connected to the I/O modules and their functions will be disclosed later. Additional input connections are also made to the main control panel from the puncher and smelting vessel for connection to the I/O modules.

Figure 3:
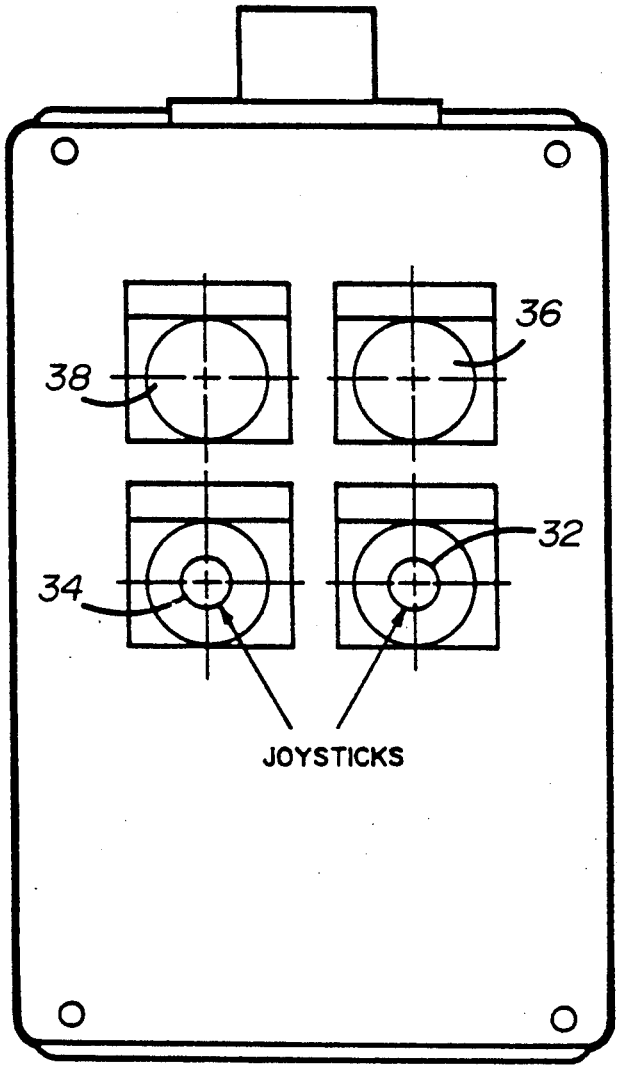
FIG. 3 shows the pendant or remote control panel.

A pendant 30 or remote control panel (similar to that used by a remote crane operator) is also connected to the I/O modules. It is a small control box which can be located in the cab of the tuyere puncher or mounted at the ends of the punching area. It contains joysticks 32 and 34 for control of manual or semi-automatic operation and speed of the tuyere puncher, an operational mode switch 36 and a start/stop lock-out key switch 38 as shown in FIG. 3. The functions of the pendant will be disclosed later.

The functions of the various switches and lights mounted on the main control panel are as follows:

Tuyere Status Switches

Tuyere status switches 1SS to 56SS are lighted switches (one for each tuyere), which allow the operator to "blockout" a tuyere to prevent it being punched. When the tuyere is "blocked out" the status light will be turned on. If, during automatic punching, the puncher is unable to complete the punching operation ("No punch"), the status lights for the tuyeres affected will flash. Additional switch locations 57SS–60SS are also provided on the panel for other options if needed.

Bar Status Switches

The bar status switches 61SS to 64SS are an arrangement of 4 switches which are set to correspond to the punch bars loaded in the tuyere puncher numbered from left to right as viewed from the back of the machine. The information from these switches along with the tuyere status switches allows the PLC to calculate the next valid "station" for punching.

Operational Mode Selector Switch

The operational Mode selector switch 65SS allows the operator to control the mode of operation of the tuyere puncher from manual to fully automatic. In the automatic mode all operations of the puncher will be controlled by the PLC and the BCS depending on the switch settings on the main control panel. This switch lamp will be on to alert the operator to automatic mode.

In semi-automatic mode the BCS is used to position the puncher at a "station" while the punching operation is controlled directly by the operator with the joystick mounted on the remote panel. Moving the joystick to the left or right will cause the puncher to move to the next valid "station" in that direction. This mode could be used for the reaming operation to give the operator direct control of the punch bar while relieving him of the need to position the puncher accurately. While in this mode the switch lamp will be flashing. The computer will not inhibit punching in any position regardless of bars installed.

In the manual mode all operation of the puncher is directly from the joystick located on the remote panel. This allows the operator freedom to operate without computer assistance and is also used to move the puncher rapidly from one location to another as during a reaming operation, for example, before switching to semi-automatic mode to allow the BCS to do the accurate positioning. In the manual mode the switch lamp will be off.

Timer/Counter Access Module (TCAM)

This module with push buttons and LED displays is connected directly to the PLC and is used to read and change data stored in the memory of the controller. Program timers, counters and limits may be set via the TCAM as OPERATOR LOADED VARIABLES. Error codes will be placed in fixed locations in the PLC memory when they occur, to be read via the TCAM.

Punch Mode Switch

The option of starting and stopping punching based on air flow or pressure through the tuyeres, starting at a fixed time interval or a combination of both is the purpose of the punch mode switch 66SS. When it is in the Air position, punching will start when the total air flow through the tuyeres drops below a minimum value or the air pressure exceeds a maximum value. These values are entered via the TCAM. Punching will stop when the air flow exceeds a maximum value or the air pressure drops below a minimum value, also entered via the TCAM, and the puncher will return to the home position. When the punching restarts because of low air flow or high air pressure it will start with the next tuyere after the last one punched prior to stopping.

In the Time position, punching will start at the tuyere nearest the "home" position and proceed to punch until all tuyeres are punched. The puncher will then return to the "home position". Punching will recommence when a fixed time interval, entered via the TCAM has elapsed.

In the Combination position, punching will start if the air flow drops below the minimum value or the air pressure exceeds the maximum value as entered in the TCAM or when the specified time interval has elapsed since the last completion of punching. If punching is started by low air flow or high pressure it will start with the tuyere after the one last punched and continue punching until the air flow reaches the maximum value or the air pressure drops below the minimum value specified (as in the Air position). If the punching is started by the timer it will start from the "home" position and punch all tuyeres to the end (as in the Time position).

Punching Direction Switch

The switch 67SS is used to change the direction of punching and the normal "home" or parking location of the puncher. If the switch is changed during punching the puncher will then proceed to the new "home" location. If the switch is changed while the puncher is parked it will then travel to the new "home" location.

Bar Cooling Switch

The switch 68SS is used to switch a bar cooling water spray or an air jet on or off.

Safety Gate Error Light

The 1LT light will be illuminated if a safety gate leading to the puncher area is open. The environment error light 4LT will also be on.

Trip Switch Error Light

The 2LT light will be illuminated if a safety trip switch on the puncher is tripped. The tuyere puncher error light 5LT will also be on.

Control Error Light:

An error in the PLC or the BCS will cause the 3LT error lamp to be illuminated.

Environment Error Light

A problem related to the smelting vessel, associated equipment or a safety gate error will cause the 4LT lamp to be illuminated.

Tuyere Puncher Error Light

Any problem directly related to the operation of the tuyere puncher will cause the 5LT light to be illuminated.

Other Error Lights

Light 6LT will be illuminated if the smelting vesel has rolled out of its blowing position, light 7LT if no power is supplied to the puncher, and light 8LT if the puncher has no or low air pressure.

Emergency Stop Button

The 1PB button will trip a relay to remove all power from the outputs of the PLC immobilizing the tuyere puncher.

Clear Error Button

The 2PB push button will clear all of the flashing tuyere status ("No punch" tuyeres) errors along with the alarm signal. Cancellation of the alarm causes the control, environment and tuyere puncher error lamps to flash sequentially. If the button is depressed a second time (toggled) the "No punch" errors will still be cancelled; however, the alarm will again be functional and the sequential error lamp flashing will stop.

Override Reactor Position

The 3PB punch button (toggle on and off) allows the semi and fully automatic operational modes to be available for use. This is normally only a machine test option as the control system operates as if the smelting vessel is in position to be punched. All punch bars must be removed from the puncher before operating the overriding smelting vessel position push button.

Power on

The 4PB button operates a relay to switch power to the PLC.

Lamp Test Push Button

The 5PB push button is used to test all of the lamps. Pressing it will cause all of the panel lamps to be illuminated.

Start Automatic Punching On Command Button

The 6PB push button is used to start the automatic punching sequence. This is possible only if the system is in the automatic mode (both main panel and pendant mode switches must be set to AUTO). The punching will continue independent of both time and air flow. To stop punching the operator must again depress the switch (i.e. a toggle).

The above main control panel with the TCAM and the various switches, push-buttons and lights act as an operator interface with the system and could be replaced by a CRT and keyboard.

The functions of the pendant are as follows:

a) Joystick Control

In manual mode, lateral motion of the right hand joystick 32 is used to control the motion of the tuyere puncher along the track. The second joystick 34 is mounted to the left of the main one and allows shifting into high speed.

In semi-automatic mode, lateral motion of the joystick causes the BCS to control the motion of the tuyere puncher to the next "station", where it will stop.

Forward motion of the joystick, in manual or semi-automatic mode, is used to control the punching action.

In automatic mode the joystick is inactive.

b) Operational Mode Switch

The operational mode switch 36 operates in the same way as the one in the main control panel. Whichever switch is in the less automatic mode controls the operation. In order to start punching, this switch must be turned to auto mode after the operator has verified the space is clear.

Once switched from manual to semi-auto the first motion of the joystick, in either direction, will move the puncher to the nearest station.

c) Lock-Out Key Switch

This key-lock switch 38 removes power from the solenoids operating the air motor and cylinder on the tuyere puncher. It is to be used by the operator to lock-out the operation before entering the puncher area and it also acts as an emergency stop switch on the pendant.

Operation of the System

Figure 4A:
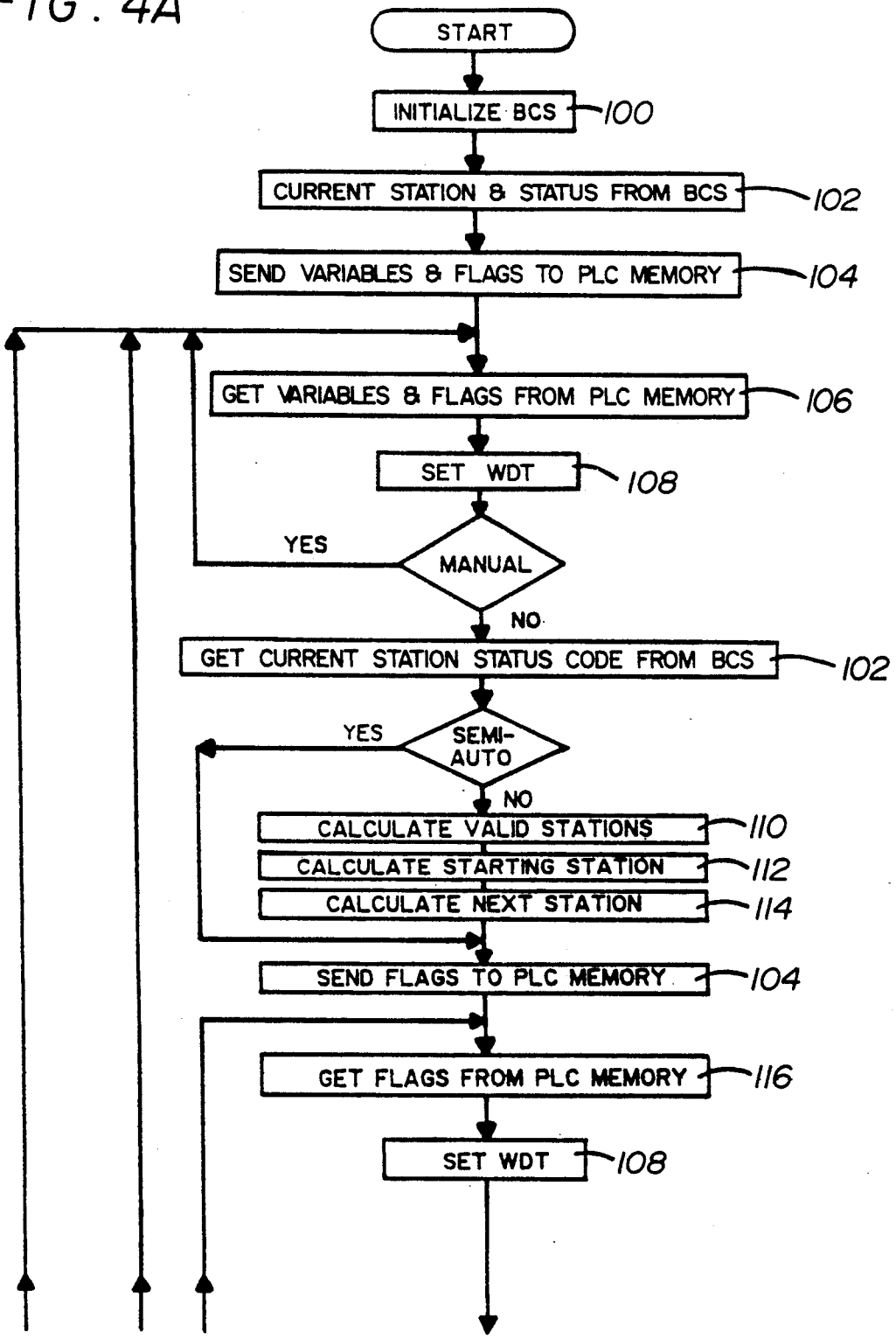
FIGS. 4, 5 and 6 are simplified flowsheets of the programs used by the programmable logic controller.
Figure 4B:
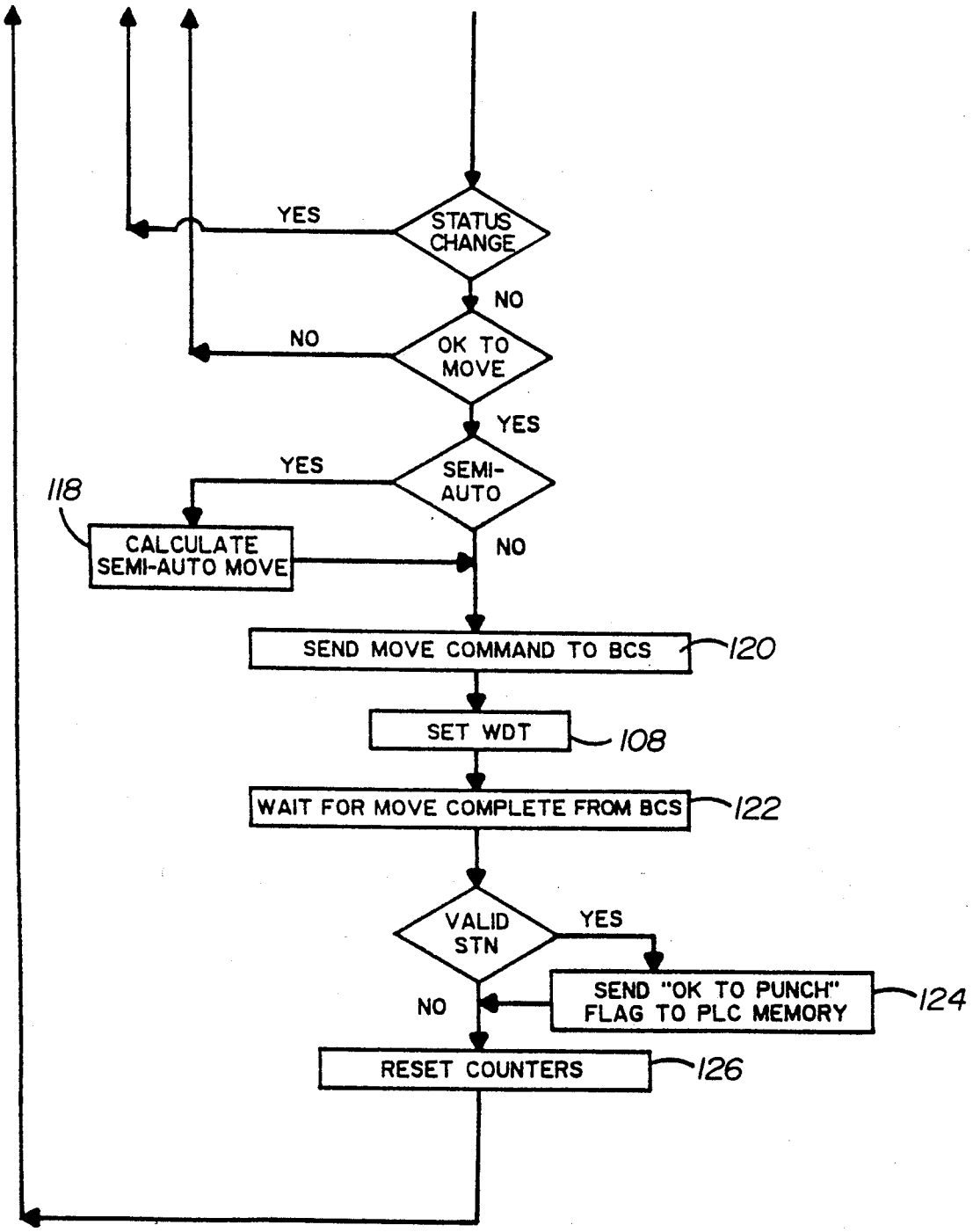
Figure 5:
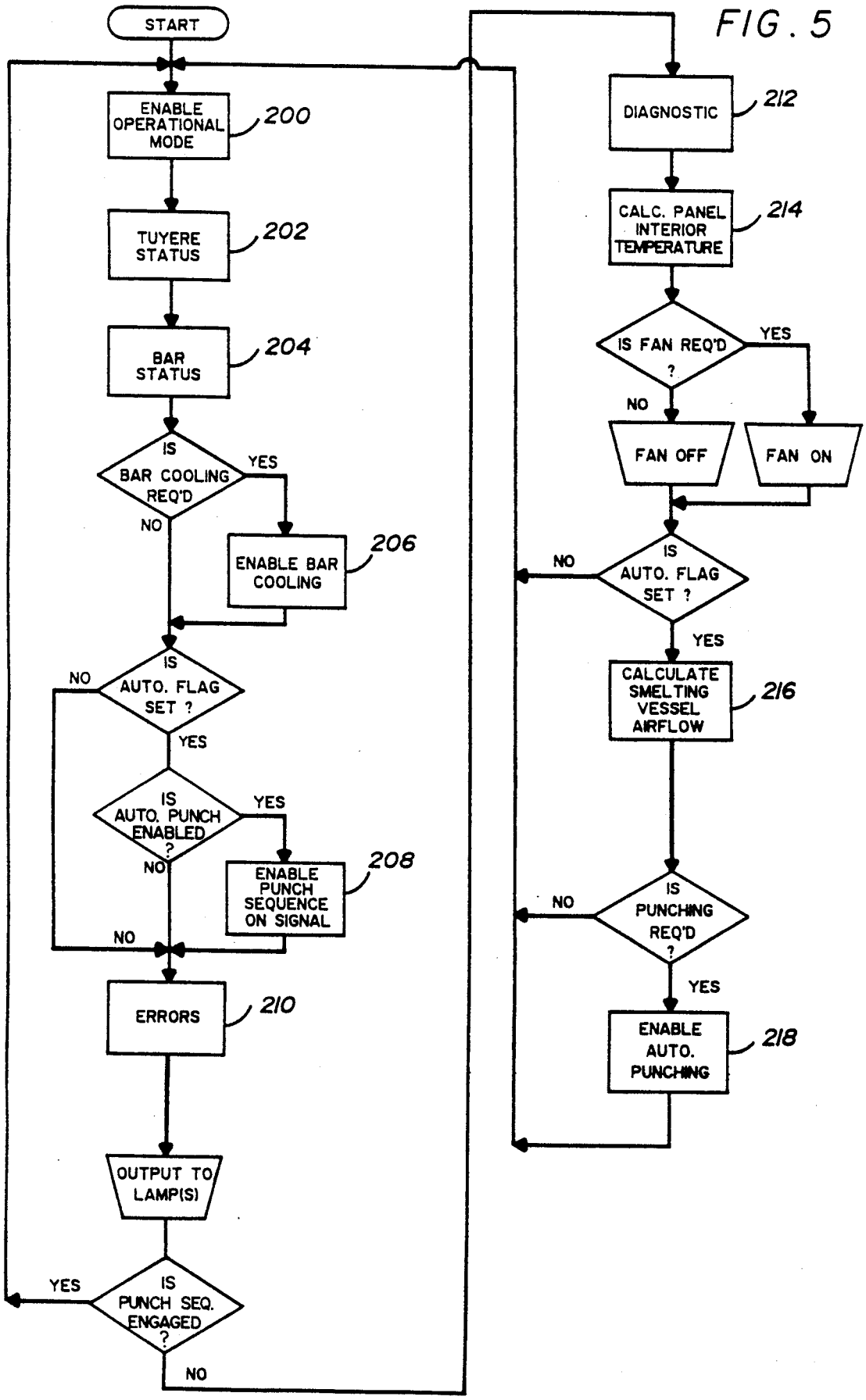
Figure 6:
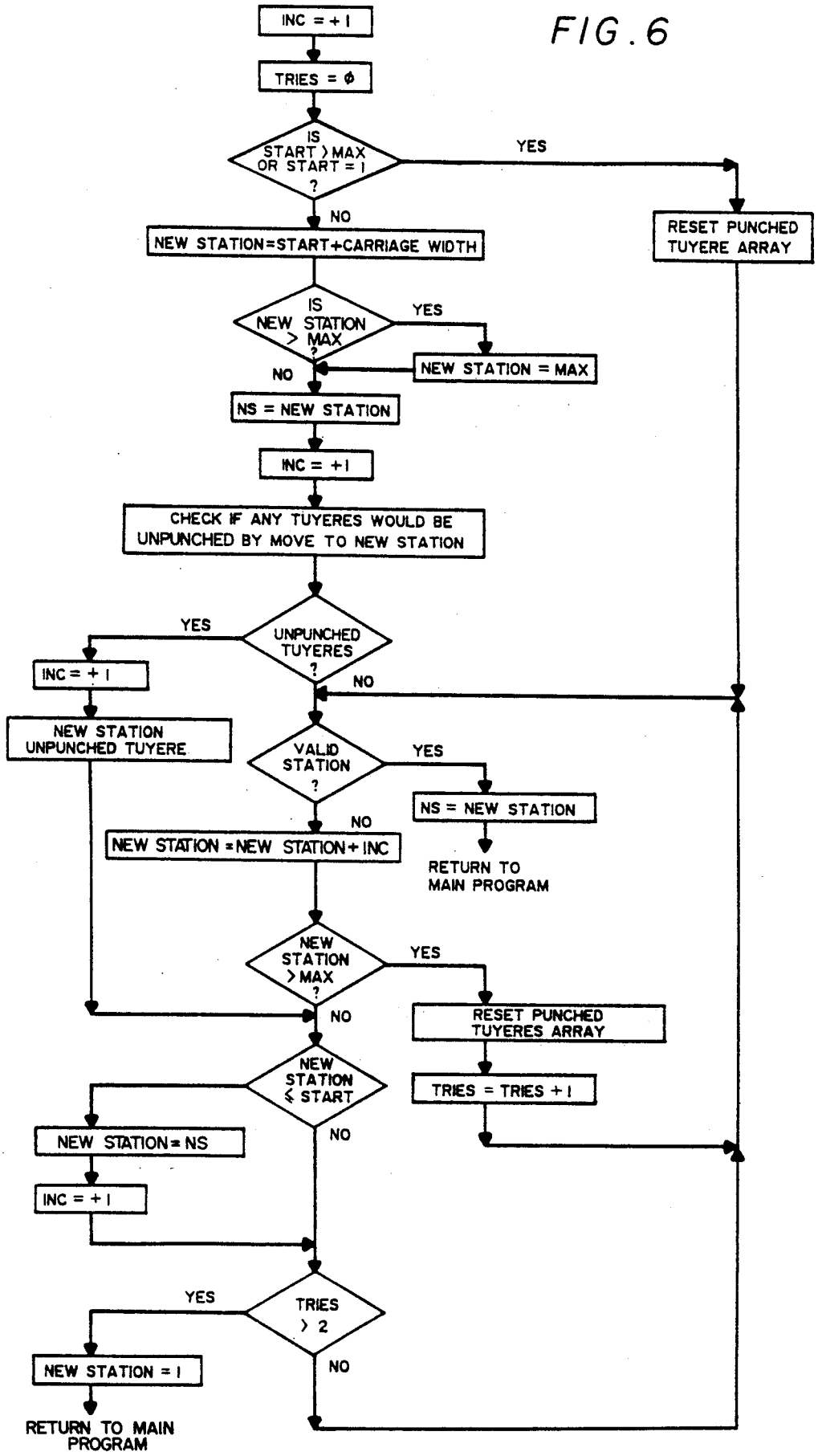

The programmable logic controller operates the puncher by following the BASIC program and the relay ladder program illustrated in the simplified flowsheets shown in FIGS. 4, 5 and 6. The following is a simplified description of the various subroutines of the above programs:

BASIC Program (FIG. 4)—Subroutine Description

Initialize BCS

The subroutine 100 sends an initialization message to the BCS prior to doing any measurements.

Get Current Station & Status Code from BCS

The subroutine 102 sends a request to the BCS asking for the present puncher location by station number, and for the status code number which describes the status of the BCS. The response from the BCS is decoded and used by the BASIC program.

Send Variables and Flags to PLC Memory

The subroutine 104 sends all of the variables and flags which may be changed by the BASIC program to the PLC memory for use by the ladder logic of the PLC processor. To facilitate programming, all values are sent, even if they have not changed.

Get Variables and Flags from PLC Memory

The subroutine 106 reads variables and flags which may be changed by the relay loader logic from the PLC memory for use by the BASIC program. To facilitate programming, all variables used are read.

Set WDT (Watch Dog Timer)

The subroutine 108 sends a flag to a PLC memory location which is used as the Watch Dog Timer (WDT). If this flag is not reset within a specified time, the PLC processor assumes a failure of the BASIC program (or module) and sets an alarm.

Calculate Valid Stations

The subroutine 110 determines by simulation of the movement of the puncher which "stations" may be used for punching with the current configuration of punch bars and "blocked off" tuyeres. This is to ensure that "blocked off" tuyeres are not punched.

Calculate Starting Station

The subroutine 112 calculates the station where the puncher would restart punching if punching was stopped. This would normally be the next station in sequence if the punching was started by low air flow, but would be the "home" position if a time sequence is used.

Calculate Next Station Subroutine

The subroutine 114 calculates the next station for the puncher to move to, ensuring that all possible tuyeres are punched, and none are repunched unnecessarily. As shown in FIG. 6, the subroutine first checks if the puncher is currently at either the first or last station, and if so, it clears an array in memory containing the punched status of all tuyeres i.e. it sets all tuyeres to "unpunched" status. Then it checks the validity of that station. If the puncher is not at either end station, a new station is calculated by adding the number of stations corresponding to the distance between the right and left bars to the current position. A check is made to see if the new station exceeds the maximum. Then a check is made to see if any tuyeres would be left unpunched by this move. If there would be an unpunched tuyere, the new station is set to punch that tuyere. The validity of the new station is checked in either case, to ensure that a blocked tuyere is not punched, and if it is valid, the value is passed to the main program. If the station is not valid, the station number is decreased and the validity check is repeated until a valid station is found to be passed to the main program, or the new station is equal to the current station. Otherwise, the station number is increased until a valid station is found which is passed to the main program.

Get Flags from PLC Memory

The subroutine 116 is a subset of the subroutine 106 which gets status from PLC memory. The flags are more quickly accessed, and are used to indicate a status change, thus this subroutine reads all of the flags from the PLC memory for use by the BASIC program, and determines if a status change has occured.

Calculate Semi-Auto Move

The subroutine 118 uses the value of the variables containing the status of the pendant joystick which was read from PLC memory. If the joystick was moved left, the next station number is incremented by one, if it was moved to the right, the next station number is decremented by one. If the next station number is outside the range of station numbers, the last value is retained and the puncher does not move.

Send Move Command to BCS

The subroutine 120 sends the command to the BCS to move the puncher to a particular station. This command is a simple character string which contains the appropriate station number.

Wait for Move Complete from BCS

The subroutine 122 continually requests the BCS for current location and status code until the status code is "on station" meaning that the puncher is at the station to which it was sent. A halt command is then sent to the BCS so that it will not try to move while punching is in progress.

Send "OK to Punch" Flag to PLC Memory

The subroutine 124 sets a flag in the PLC memory which the Relay Ladder Logic of the PLC processor uses as an indicator that it is OK to start the punching sequence.

Reset Counters

The subroutine 126 simply resets a variety of counters which were used in the program to allow a certain number of retries when the first attempt failed.

Relay Ladder Logic of the PLC Processor (FIG. 5)
Subroutine Description

Enable Operational Mode

The program segment 200 checks the status of the operational mode selector switch 65SS on the panel which may be "manual", "semi-automatic" or "automatic". A memory location is "set" corresponding to the selected mode. The key switch 38 on the pendant is then checked. If it is "off" then this subprogram restarts. The pendant mode selector switch 36 is checked to see if it corresponds to the switch on the panel. If it does, the appropriate light sequence is set ("on" for automatic, "flashing" for semi-automatic, "off" for manual), and a memory location "flag" is set to be used by the BASIC module. If the "automatic" mode is selected, there is an additional check that the pendant selector switch was switched after the panel switch.

Tuyere Status

The program segment 202 reads the position of the tuyere status switches on the main control panel and sets or clears the appropriate indicator lamps. It also reads the tuyeres being punched from memory locations and checks if an incomplete punching operation ("no punch") has occured. If a "no punch" has occured, the appropriate tuyere lamps are set flashing. If a repunch has occured successfully, the tuyere lamps are turned off.

Bar Status

The program segment 204 reads the position of the bar status lamps on the main control panel and sets or clears the appropriate lamps. If the bar status has changed a memory location "flag" is set to indicate the status change to the BASIC module.

Enable Bar Cooling

The program segment 206 checks if the "bar cooling" flag has been set by the main program and sets the appropriate lamp. If the punching cylinder is not retracted, a timer is reset. If the cylinder is retracted the timer is started, or left on, and a solenoid valve energized to initiate cooling of the bars until the timer is finished. Then the solenoid is de-energized to stop cooling.

Enable Punch Sequence

The program segment 208 first checks the puncher operating parameters and safety interlocks then waits until the "OK to punch" flag is set in memory by the BASIC module. The punching cylinder is extended and a check is made to see if the bar has reached the tuyere, as indicated by a digital input from a proximity switch located on the puncher. If the bar has not reached the tuyere, the cylinder is retracted and the sequence is repeated several times before a "no punch" flag is set in memory. Once the bar has reached the tuyere the cylinder is extended further and a check is made to see if the bar has reached the end of the tuyere, again indicated by a digital input from a proximity switch on the puncher. If the bar has not reached the end of the tuyere, the bar is retracted and the sequence is repeated several times before a "no punch" flag is set in memory. If the bar reaches the end of the tuyere, the cylinder is retracted. A check is then made to see if the cylinder is fully retracted. If the cylinder is not fully retracted, the sequence is repeated several times before a "bar stuck" flag is set in memory. Once the bar is fully retracted, the "OK to move" flag is set in memory for the BASIC module.

Error Indication

The program segment 210 reads the digital inputs and other variables which are related to system errors or to safety and sets the appropriate alarm lamps on the main panel to on or flashing.

Diagnostics

The program segment 212 checks various memory locations which contain values relating to status codes. It then sets error flags and transfers status code values to other memory locations to be read by the Timer/-Counter Access Module (TCAM) in the main panel.

Calculate Panel Interior Temperature

This program segment 214 reads the analog voltage value obtained from a thermistor mounted inside the main panel and converts it to a temperature value which can be used to determine if a cooling fan should be switched on or off.

Calculate Smelting Vessel Airflow

This program segment 216 reads the analog voltage value obtained from the smelting vessel air flow transmitter and converts it to a flow value which can be used to determine if punching is required.

Enable Auto Punch

This program segment 218 first determines the punching mode "air flow or pressure", "time" or "combination" and sets the appropriate flags and lights. If the "punch on command" push button has been pressed the appropriate flags and lamps are set to start or stop punching, and the "OK to move" flag is set for the BASIC module.

If the "time" mode is selected the timer is checked, and started if it is not already running, or the "punch enable" and "OK to move" flags are set if it is time to punch. If punching is to be started because of pressure or airflow, the "punch enable" and "OK to move" flags are set.

Normal operation of the tuyere puncher is initiated by an operator when the smelting vessel is turned to the blowing position and the tuyere level aligns with the punch bars on the tuyere puncher.

The operator selects on the main panel:

a) The tuyeres he wishes to exclude from punching (Switches 1SS to 56SS)
b) The number of bars and position on the puncher (Switches 61SS to 64SS)
c) The operational mode: Auto, Semi-Auto, Man) (Switch 65SS)
d) The punch starting mode: Air flow or pressure, Time, Combination (Switch 66SS)
e) The direction of punching or "home" position (Switch 67SS)
f) The bar cooling jets on or off (Switch 68SS)
g) The parameter limits of operation (TCAM)

Then the operator will start the system on the main panel (Push button 4PB) and turn the lock-out key switch (#38) on the pendant to the "on" position. After checking and correcting errors indicated by the main panel error lights 1LT to 8LT, the operator will set the operational mode required (Auto, Semi-Auto, Man) on the pendant.

In the automatic mode, all operations of the puncher will be controlled by the BCS and PLC. To summarize the previously described functions of these elements, the BASIC module 22 of the PLC communicates with the BCS to get the current puncher location by station number and checks the tuyere and bar status flags set in memory by the PLC processor to calculate the next valid station for punching. Based on this information the BASIC module gives command to the BCS to move to the calculated station number and sets an "OK to punch" flag in memory. The PLC processor reads the "OK to punch" flag in memory and controls all outputs to the tuyere puncher and the main control panel.

In the semi-automatic mode the BCS is used to position the puncher at a station while the punching operation is controlled directly by the operator with the joysticks mounted on the remote panel.

In the manual mode, all operation of the puncher is directed from the joysticks located on the remote panel.

Although the invention has been disclosed with reference to a preferred embodiment, it is to be understood that it is not limited to such embodiment and that other alternatives are also envisaged within the scope of the following claims.

We claim:

1. A system for automatically or semi-automatically controlling the operation of a tuyere puncher which is movable along a smelting vessel to punch a series of tuyeres mounted on the smelting vessel comprising:

a) a single distance measuring device which measures the distance of the movable puncher from a reference position;

b) a programmable device having a memory which stores the position of each tuyere relative to said reference position, having the capability of communicating with the distance measuring device to obtain the current puncher position, an input capability to read signals from external devices, an output capability to control indicating devices and the movement and punching operations of the puncher, and a calculating facility to determine the motion of the puncher to punch all possible punchable tuyeres.

2. A system as defined in claim 1, wherein said distance measuring device includes said memory for storing the position of each tuyere relative to the reference position and means to control the motion of the puncher toward each tuyere position.

3. A system as defined in claim 1, wherein said programmable device is a programmable logic controller having a plurality of input/output modules for providing said input/output capabilities and a BASIC module for providing said calculating facility to determine the motion of the puncher and the capability to communicate with the distance measuring device.

4. A system as defined in claim 3, further comprising an operator interface including a main control panel having mounted thereon a plurality of tuyere status switches, one for each tuyere, which allow an operator to block out any tuyere to prevent it from being punched, and a plurality of bar status switches, one for each punch bar used by the tuyere puncher, said tuyere and bar status switches being connected to said input/output modules for input signals which allow the basic module of said programmable logic controller to calculate the next valid station for punching.

5. A system as defined in claim 4, further comprising a punching direction switch mounted on the panel and connected to said input/output modules to allow the operator to change the direction of punching and the normal "home" or parking location of the puncher.

6. A system as defined in claim 4, further comprising an operational mode selector switch mounted on the panel and connected to said input/output modules to allow the operator to control the mode of operation of the tuyere puncher for automatic, semi-automatic and manual operation.

7. A system as defined in claim 4, further comprising a punch mode switch mounted on the panel and connected to said input/output modules to allow the option of starting and stopping punching based on air flow or pressure through the tuyeres, starting at a fixed time interval, or a combination of both.

8. A system as defined in claim 4, further comprising a Timer/Counter Access Module (TCAM) mounted on said panel and connected directly to the memory to allow the operator to read and change data stored in the memory.

9. A system as defined in claim 4, further comprising a bar cooling switch mounted on the panel and connected to the input/output modules to allow the operator to activate automatic operation of a bar cooling water spray or air jet.

10. A system as defined in claim 4, further comprising a "start automatic punching on command" push button mounted on the modules and connected to the input/output devices to allow the operator to start automatic punching independent of both time and air flow.

11. A system as defined in claim 4, further comprising a pendant or remote control panel located on the tuyere puncher or in the vicinity of the puncher and comprising joysticks for control of manual or semi-automatic operation of the puncher.

12. A system as defined in claim 3, further comprising an operator interface including a CRT and keyboard.

* * * * *

UNITED STATES PATENT AND TRADEMARK OFFICE

CERTIFICATE OF CORRECTION

PATENT NO. : 4,989,839

DATED : February 5, 1991

INVENTOR(S) : SIMMS et al.

It is certified that error appears in the above-identified patent and that said Letters Patent is hereby corrected as shown below:

On the Title Page, left column, please correct the assignees as follows:

[73] Assignee: Heath and Sherwood (1964) Limited, Ontario, Canada and Noranda Inc., Toronto, Canada

Signed and Sealed this

Twenty-fifth Day of August, 1992

*Attest:*

DOUGLAS B. COMER

*Attesting Officer*

*Acting Commissioner of Patents and Trademarks*